United States Patent [19]

Bruning et al.

[11] Patent Number: 4,784,633

[45] Date of Patent: Nov. 15, 1988

[54] CENTRIFUGE WITH A DRUM HAVING SOLIDS-EXTRACTION OPENINGS

[75] Inventors: Paul Bruning; Helmut Figgener, both of Oelde, Fed. Rep. of Germany

[73] Assignee: Westfalia Separator AG, Oelde, Fed. Rep. of Germany

[21] Appl. No.: 35,572

[22] Filed: Apr. 7, 1987

[30] Foreign Application Priority Data

Apr. 17, 1986 [DE] Fed. Rep. of Germany ..... 3612919

[51] Int. Cl.[4] ..... B04B 1/20

[52] U.S. Cl. ..... 494/41; 494/38; 494/56

[58] Field of Search ..... 494/44, 40, 58, 62, 494/82, 27, 71, 29, 36, 56, 63, 64, 39, 41, 15, 30, 53, 26, 25, 48

[56] References Cited

U.S. PATENT DOCUMENTS

| | | | |
|---|---|---|---|
| 4,512,759 | 4/1985 | Alink et al. | 494/41 |
| 4,685,899 | 8/1987 | Cvitas et al. | 494/44 |
| 4,708,711 | 11/1987 | Scherer | 494/41 |

*Primary Examiner*—Timothy F. Simone

*Attorney, Agent, or Firm*—Sprung Horn Kramer & Woods

[57] ABSTRACT

A centrifuge drum is provided with a seal consisting of a narrow gap between the drum and centrifuge housing. The seal is located between the actual housing and the solids catch chamber. There is a pressure-compensation space at the drum in the vicinity of the seal. The exchange of air that occurs at the seal in a centrifuge without the compensation space between the solids catch chamber and the housing in accordance with the invention and that leads to deposits of solids in the housing is accordingly displaced into the compensation space.

4 Claims, 1 Drawing Sheet

CENTRIFUGE WITH A DRUM HAVING SOLIDS-EXTRACTION OPENINGS

BACKGROUND OF THE INVENTION

The present invention relates to a centrifuge with a rotating drum provided with solids-extraction openings, with a stationary housing surrounding the drum, with a solids catch chamber, and with at least one seal in the form of a narrow gap between the rotating drum and the stationary housing.

A centrifuge of this type is known, for example, from German Pat. No. 2 256 541. The centrifuge is provided with a knife-edged demarcating disk, which peels off any contamination that cakes onto the adjacent walls of the solids catch chamber. It is, however, impossible to prevent particles of solids entrained by air exchange from depositing in the housing of the centrifuge. The shape of the solids catch chamber in a cylindrical housing deviates from the shape of the housing due to the solids outtake. Thus, although the pressure in the vicinity of the housing is evenly distributed by the rotating drum, zones of pressures that are higher or lower than that in the housing itself occur in the asymmetrical cross-section of the catch chamber. Air constantly flows into the housing from the zones of higher pressure and from the housing into the zones of lower pressure in the catch chamber. The air flowing into the housing is charged with solid particles that precipitate in it and can cause malfunctions.

SUMMARY OF THE INVENTION

The object of the present invention is to prevent air exchange between the solids catch chamber and the housing and accordingly avoid deposits of solids in the housing.

This object is attained in accordance with the invention by the improvement wherein the drum is provided with a pressure-compensation space in the vicinity of the seal.

The air exchange between the housing and the solids catch chamber is accordingly displaced into the upstream pressure-compensation space because, since it is rotationally symmetrical like the housing, the pressure conditions inside the compensation space are the same as those in the housing. Thus, no significant volume of air is exchanged between the compensation space and the housing, and solid particles can precipitate only in the compensation space, from which they can be centrifuged out.

To improve the self-cleaning capacity of the compensation space, the radially outer surface of the pressure-compensation space extends out at an acute angle "a" to the axis of rotation. This angle is preferably at least 40°, which is more obtuse than the maximum natural angle of repose of the centrifugates usually processed in this type of centrifuge.

In one practical embodiment of the invention, the flow cross-section of the pressure-compensation space as measured at its edge precisely equals the flow cross-section of the annular gap, which continues around that circumference. Thus, the flow rate in the compensation space will be only approximately 10% of the flow rate in the gap. This is due to only about 10% of the flow cross-section of the annular gap being actually available for air to flow through into the compensation space through. The effective flow cross-section of the compensation space is to be understood as the area resulting from a section through its central axis. Air that enters the compensation space through the gap will flow tangentially in both directions inside the compensation space and emerge at another point along the gap.

The pressure-compensation space can be accommodated in a demarcating disk that can be detached from the drum. This measure makes it easier to adapt to different conditions.

Some preferred embodiments of the invention will now be specified with reference to the attached drawings, wherein:

DETAILED DESCRIPTION OF THE PREFERRED EMBODIMENTS

Figure 1:
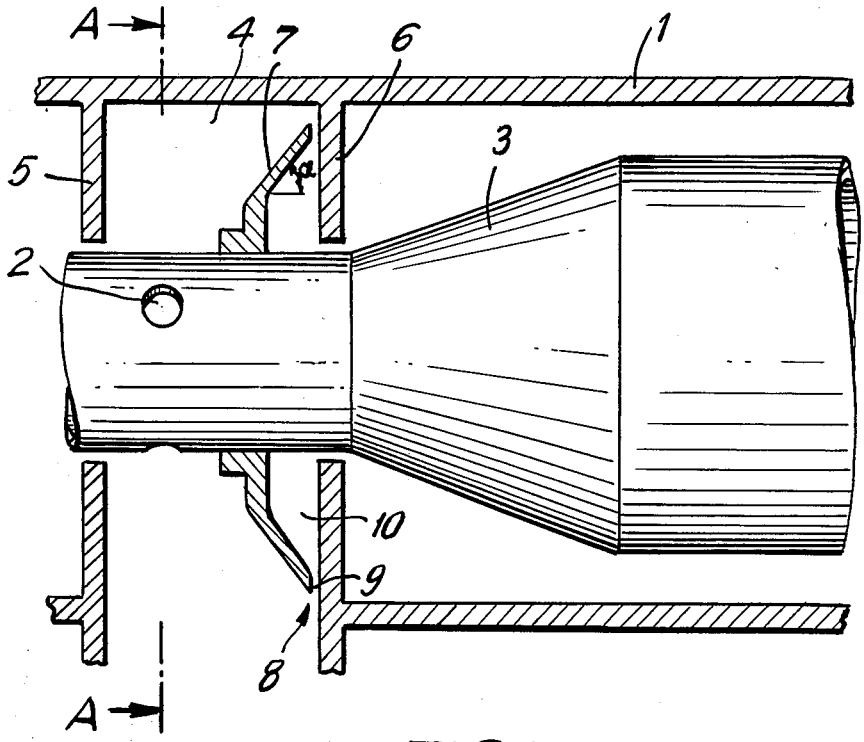
FIG. 1 is a section through the centrifuge according to the invention in the vicinity of the solids catch chamber and FIG. 2 is a section along the line A—A in FIG. 1.

The housing 1 of the completely enclosed screw-type centrifuge illustrated in FIG. 1 surrounds a drum 3 provided with solids-extraction openings 2. Associated with solids-extraction openings 2 is a solids catch chamber 4 that is demarcated by walls 5 and 6. Mounted on drum 3 between solids-extraction openings 2 and wall 6 is a rotating demarcating disk 7. Between rotating demarcating disk 7 and wall 6 a seal 8 is created by a narrow gap 9 that communicates with solids catch chamber 4. Demarcating disk 7 accommodates a pressure-compensation space 10 in the vicinity of seal 8. Demarcating disk 7 can be detached from drum 3. The flow cross-section of gap 9 is the product of its width and circumference. The flow cross-section of compensation space 10 is the total sectional area of the compensation space.

To improve the self-cleaning capacity of the compensation space, the radially outer surface of the pressure-compensation space extends out at an acute angle "a" to the axis of rotation. This angle is preferably at least 40°, which is more obtuse than the maximum natural angle of repose of the centrifugates usually processed in this type of centrifuge.

Figure 2:
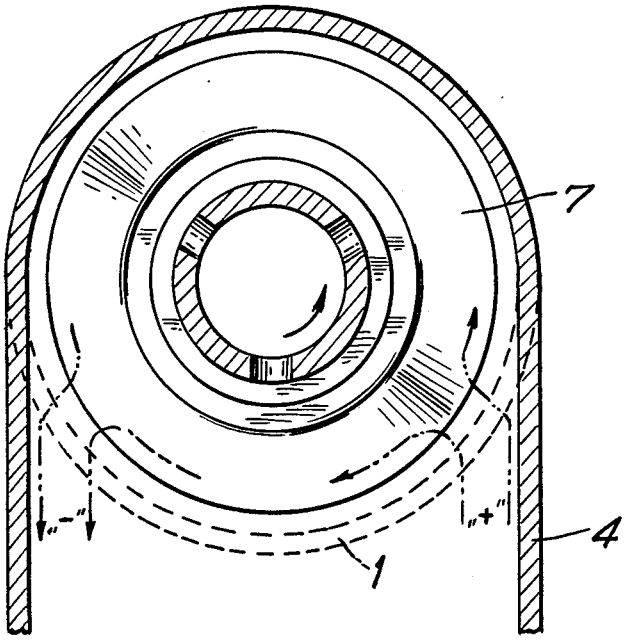

FIG. 2 shows the difference in the shapes of housing 1 and solids catch chamber 4. Whereas a uniform pressure distribution builds up around drum 3 in housing 1 and in compensation space 10 when the centrifuge is in operation, zones of lower pressure, indicated by the minus signs in the drawing, and zones of higher pressure, indicated by the plus signs, occur in solids catch chamber 4. In the higher-pressure zones air enters compensation space 10, and in the lower-pressure zones air enters solids catch chamber 4 from compensation space 10. Since the air-entry and exit area is restricted to only approximately 10% of the circumference of gap 9 at the circumference of the compensation space, the velocity at which the air flows inside the compensation space is also reduced to approximately 10% of the velocity in gap 9 even though the flow cross-sections of gap 9 and of compensation space 10 are theoretically equal.

Since the lower flow velocity in compensation space 10 results in only a negligibly lower pressure drop there, no significant air exchange occurs between compensation space 10 and housing 1. The special geometry of the outer surface of compensation space 10 causes the deposited solids to be returned to solids catch chamber 4.

It will be appreciated that the instant specification and claims are set forth by way of illustration and not limitation, and that various modifications and changes may be made without departing from the spirit and scope of the present invention.

What is claimed is:

1. In a centrifuge including a rotatable drum having an axis of rotation and solids extraction openings, a stationary housing surrounding the drum and having a solids catch chamber in the vicinity of the openings, at least one seal in the catch chamber comprising means forming an annular gap between the housing and drum including a radially extending surface on the housing and a radially extending demarcating disk on the drum, the improvement comprising means forming a pressure compensation space in the vicinity of the at least one seal and between the demarcating disk and the radially extending housing surface including the demarcating disk having a radially outer surface extending outwardly from the drum at an acute angle to the axis of rotation.

2. The centrifuge as in claim 1, wherein the acute angle is preferably at least 40°.

3. The centrifuge as in claim 1, wherein the pressure compensation space is disposed radially inwardly of the gap and has a flow cross-section at the gap which is precisely equal to the flow cross-section of the annular gap.

4. The centrifuge as in claim 1, wherein the demarcating disk is detachably connected to the drum.

* * * * *